US011493054B2

(12) United States Patent
Yagi et al.

(10) Patent No.: US 11,493,054 B2
(45) Date of Patent: Nov. 8, 2022

(54) IMPELLER OF ROTATING MACHINE AND ROTATING MACHINE

(71) Applicant: MITSUBISHI HEAVY INDUSTRIES COMPRESSOR CORPORATION, Tokyo (JP)

(72) Inventors: Nobuyori Yagi, Tokyo (JP); Noriyuki Okada, Tokyo (JP); Takashi Oda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/308,625

(22) Filed: May 5, 2021

(65) Prior Publication Data

US 2021/0404481 A1 Dec. 30, 2021

(30) Foreign Application Priority Data

Jun. 30, 2020 (JP) ..... JP2020-113188

(51) Int. Cl.
*F04D 29/22* (2006.01)
*F01D 5/04* (2006.01)
*F04D 1/06* (2006.01)

(52) U.S. Cl.
CPC ..... *F04D 29/22* (2013.01); *F01D 5/043* (2013.01); *F04D 1/06* (2013.01)

(58) Field of Classification Search
None
See application file for complete search history.

(56) References Cited

U.S. PATENT DOCUMENTS 6,340,287 B1 * 1/2002 Eino ..... F04D 17/125 415/199.1
8,469,669 B2 * 6/2013 Ressing ..... F04D 29/284 416/189
9,803,654 B2 10/2017 Yagi et al.
9,897,101 B2 * 2/2018 Saito ..... F04D 29/284
2006/0042588 A1 * 3/2006 Kindi ..... F04D 29/462 123/306
2010/0189568 A1 * 7/2010 Watanabe ..... B23K 1/0018 29/889
2013/0251531 A1 * 9/2013 Yagi ..... F04D 17/12 416/198 R (Continued)

FOREIGN PATENT DOCUMENTS

JP 2012-193653 A 10/2012
JP 2016-180400 A 10/2016
JP 2018-145910 A 9/2018

OTHER PUBLICATIONS

The extended European Search Report dated Nov. 5, 2021, issued to the corresponding EP application No. 21179849.1 (10 pages).

*Primary Examiner* — Michael Lebentritt
(74) *Attorney, Agent, or Firm* — Osha Bergman Watanabe & Burton LLP

(57) ABSTRACT

An impeller of a rotating machine according to at least one embodiment includes: a disc; a cover disposed on an opposite side of a radial passage from the disc in an axial direction; and a blade disposed between the disc and the cover. A back surface of the disc has a recess extending in a circumferential direction in a radial range where the blade is disposed.

14 Claims, 7 Drawing Sheets

(56) References Cited

U.S. PATENT DOCUMENTS

| | | | | |
|---|---|---|---|---|
| 2013/0272895 | A1* | 10/2013 | Nakaniwa | F04D 29/624<br>29/889 |
| 2014/0064975 | A1 | 3/2014 | Yagi et al. | |
| 2014/0356179 | A1* | 12/2014 | Yagi | F04D 17/12<br>416/223 R |
| 2015/0226233 | A1* | 8/2015 | Yagi | F04D 29/662<br>416/144 |
| 2017/0227012 | A1* | 8/2017 | Hirata | F04D 29/0516 |
| 2019/0055962 | A1* | 2/2019 | Nakaniwa | F04D 29/701 |
| 2020/0032810 | A1* | 1/2020 | Konno | F04D 29/266 |
| 2020/0271124 | A1* | 8/2020 | Oda | F04D 29/444 |

* cited by examiner

Section IV(A)

Section IV(B)

Section IV(C)

Section V(A)

Section V(B)

Section V(C)

IMPELLER OF ROTATING MACHINE AND ROTATING MACHINE

TECHNICAL FIELD

The present disclosure relates to an impeller of a rotating machine and a rotating machine.

BACKGROUND

As an example of rotating machines, Patent Document 1 discloses a centrifugal compressor including multiple stages of impellers arranged in the axial direction (for example, see Patent Document 1).

CITATION LIST

Patent Literature

Patent Document 1: JP2016-180400A

SUMMARY

Rotating machines such as a compressor are required to be smaller and less costly. As a method for responding to such requirements, for example, increasing the peripheral speed of the impeller may be mentioned.

However, simply increasing the rotational speed of the impeller increases the centrifugal force acting on the impeller, which causes an undesired phenomenon due to deformation of the impeller or the like. Therefore, it is not easy to increase the peripheral speed of the impeller.

In view of the above circumstances, an object of at least one embodiment of the present disclosure is to increase the peripheral speed of an impeller of a rotating machine.

(1) An impeller of a rotating machine according to at least one embodiment of the present disclosure comprises: a disc; a cover disposed on the opposite side of a radial passage from the disc in the axial direction; and a blade disposed between the disc and the cover. A back surface of the disc has a recess extending in the circumferential direction in a radial range where the blade is disposed.

(2) An impeller of a rotating machine according to at least one embodiment of the present disclosure comprises: a disc; a cover disposed on the opposite side of a radial passage from the disc in the axial direction; and a blade disposed between the disc and the cover. The cover has a maximum thickness between a radially inner end and a radially outer end, and the cover has a minimum thickness on the outer side of a radial position where the cover has the maximum thickness such that a ratio of the minimum thickness to the maximum thickness is in a range of 0.2 to 0.6.

(3) A rotating machine according to at least one embodiment of the present disclosure comprises the impeller having the above configuration (1) or (2).

According to at least one embodiment of the present disclosure, it is possible to increase the peripheral speed of an impeller of a rotating machine.

DETAILED DESCRIPTION

Embodiments of the present disclosure will now be described in detail with reference to the accompanying drawings. It is intended, however, that unless particularly identified, dimensions, materials, shapes, relative positions, and the like of components described in the embodiments shall be interpreted as illustrative only and not intended to limit the scope of the present disclosure.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

(Overall Configuration of Centrifugal Compressor 1)

Hereinafter, a multi-stage centrifugal compressor including multiple stages of impellers arranged in the axial direction will be described as an example of the rotating machine.

Figure 1:
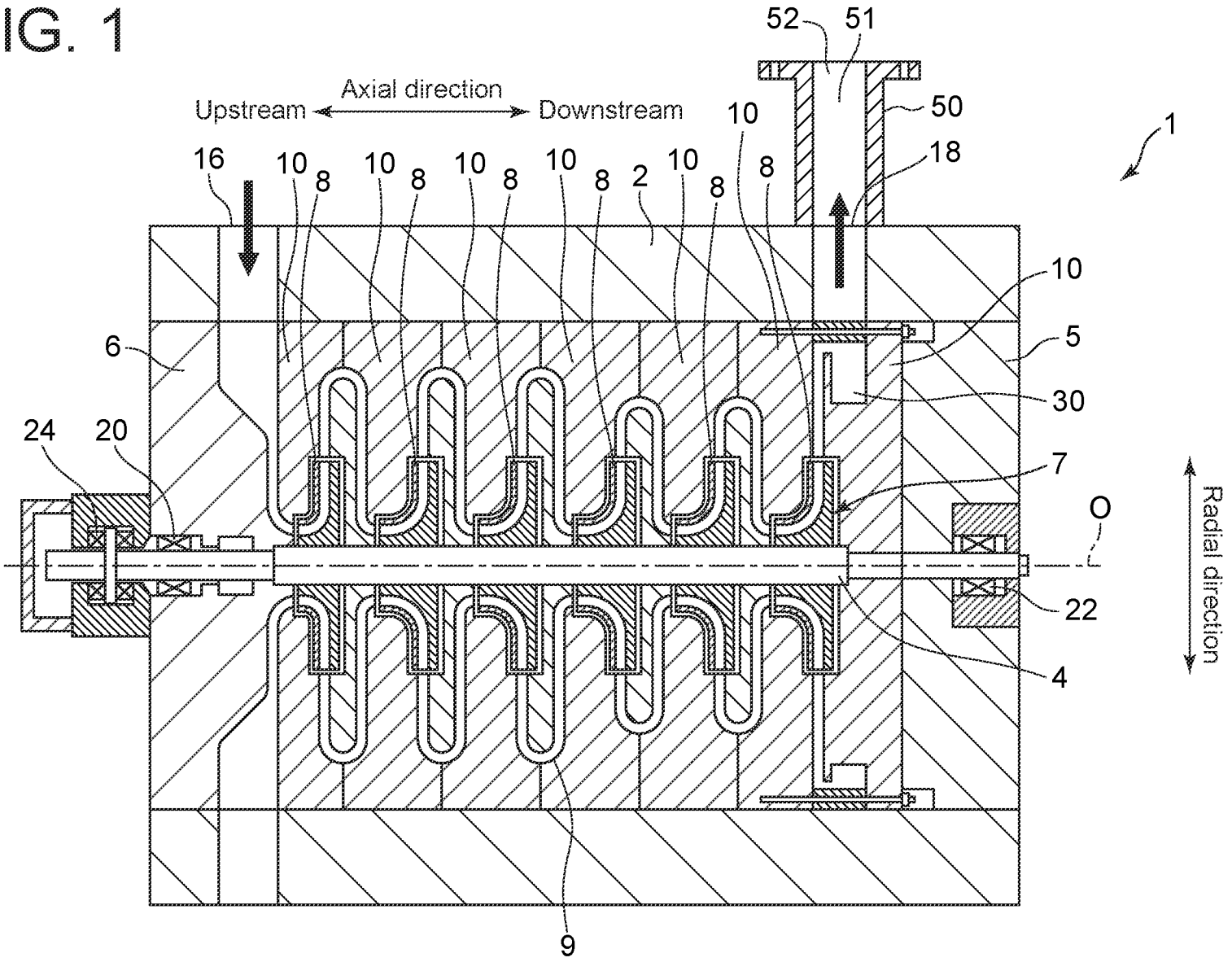
FIG. 1 is a cross-sectional view of a centrifugal compressor according to some embodiments, taken along the axial direction of a rotational shaft.

FIG. 1 is a cross-sectional view of a centrifugal compressor according to some embodiments, taken along the axial direction of a rotational shaft.

As shown in FIG. 1, the centrifugal compressor 1 includes a casing 2 and a rotor 7 rotatably supported within the casing 2. The rotor 7 includes a rotational shaft (shaft) 4 and multi-stage impellers 8 fixed to an outer surface of the shaft 4.

The casing 2 accommodates a plurality of diaphragms 10 arranged in the axial direction. The diaphragms 10 are disposed so as to surround the impeller 8 from the radially outer side. Additionally, casing heads 5, 6 are disposed on both sides of the diaphragms 10 in the axial direction.

The rotor 7 is rotatably supported by radial bearings 20, 22 and a thrust bearing 24 so as to rotate around the center O.

A first end of the casing 2 has an intake port 16 through which a fluid enters from the outside, and a second end of the casing 2 has a discharge port 18 through which a fluid compressed by the centrifugal compressor 1 is discharged to the outside. Inside the casing 2, a flow passage 9 is formed so as to connect the multi-stage impellers 8. The intake port 16 communicates with the discharge port 18 via the impellers 8 and the flow passage 9. The discharge port 18 is connected to a discharge pipe 50.

A fluid which enters the centrifugal compressor 1 thorough the intake port 16 flows from upstream to downstream thorough the multi-stage impellers 8 and the flow passage 9. The fluid is compressed stepwise by centrifugal force of the impellers 8 when passing through the multi-stage impellers 8. The compressed fluid having passed through the most downstream impeller 8 of the multi-stage impellers 8 is guided to the outside through the scroll passage 30 and the discharge port 18, and is discharged from an outlet portion 52 of a discharge passage 51 through the discharge pipe 50.

In the following description, with respect to the axial direction of the centrifugal compressor 1, the intake port 16 side is referred to as the upstream side, and the discharge port 18 side is referred to as the downstream side.

(Impeller 8)

Figure 2:
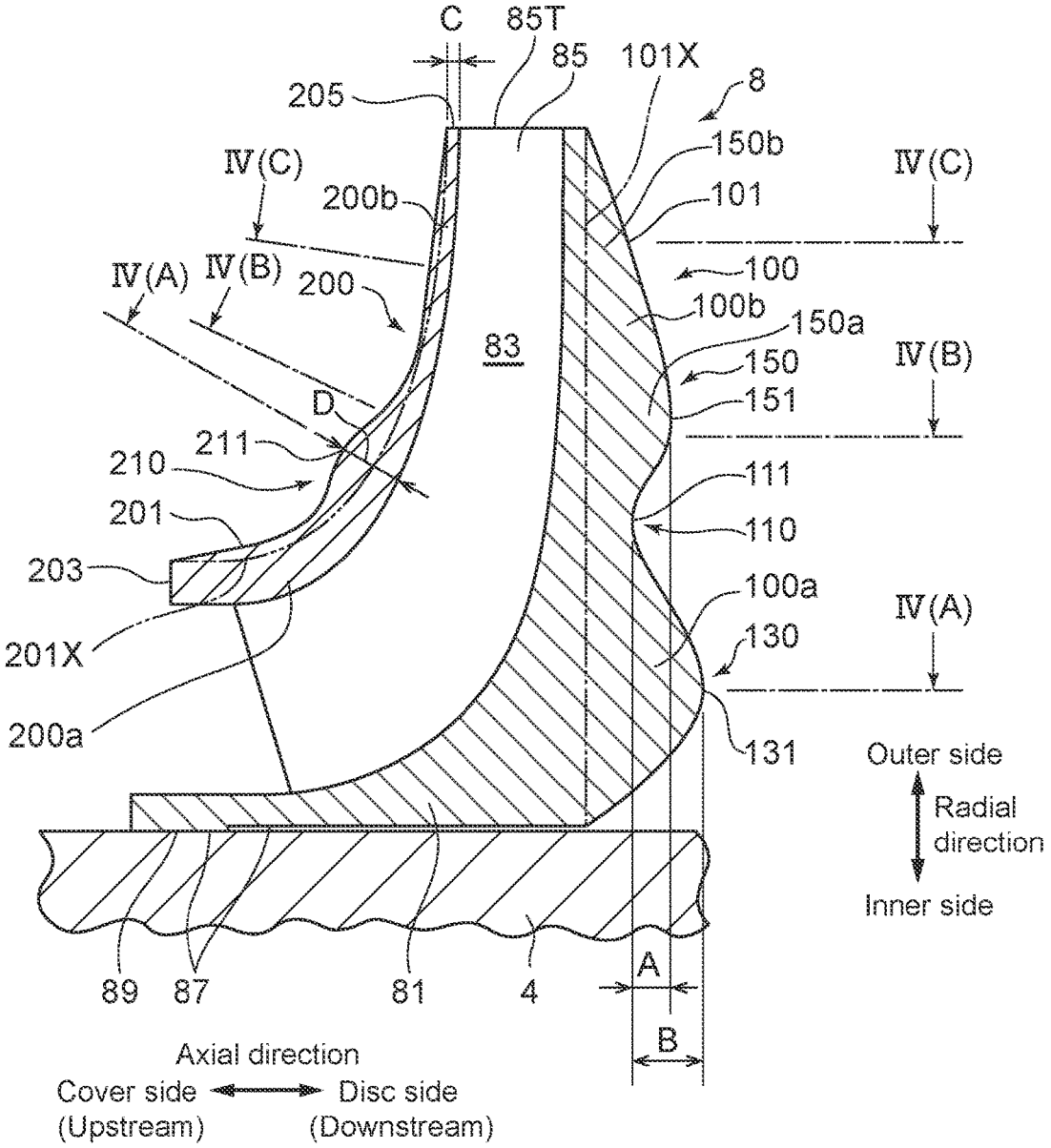
FIG. 2 is a schematic cross-sectional view of the impeller according to some embodiments, taken along the axial direction.

FIG. 2 is a schematic cross-sectional view of the impeller according to some embodiments, taken along the axial direction.

Figure 3:
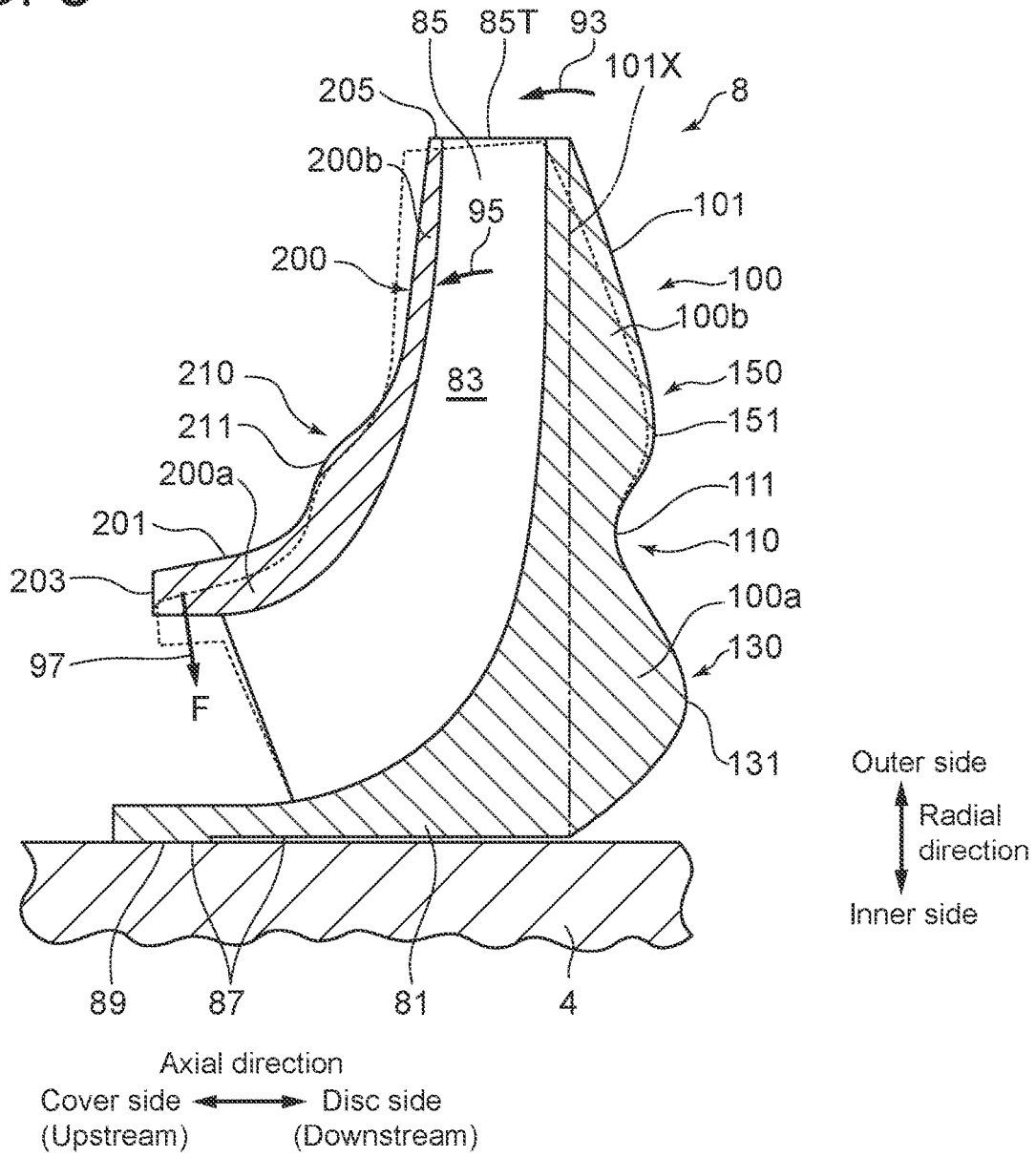
FIG. 3 is a diagram for describing deformation of the impeller according to some embodiments.

FIG. 3 is a schematic cross-sectional view of the impeller according to some embodiments, taken along the axial direction, for describing deformation of the impeller.

Figure 6:
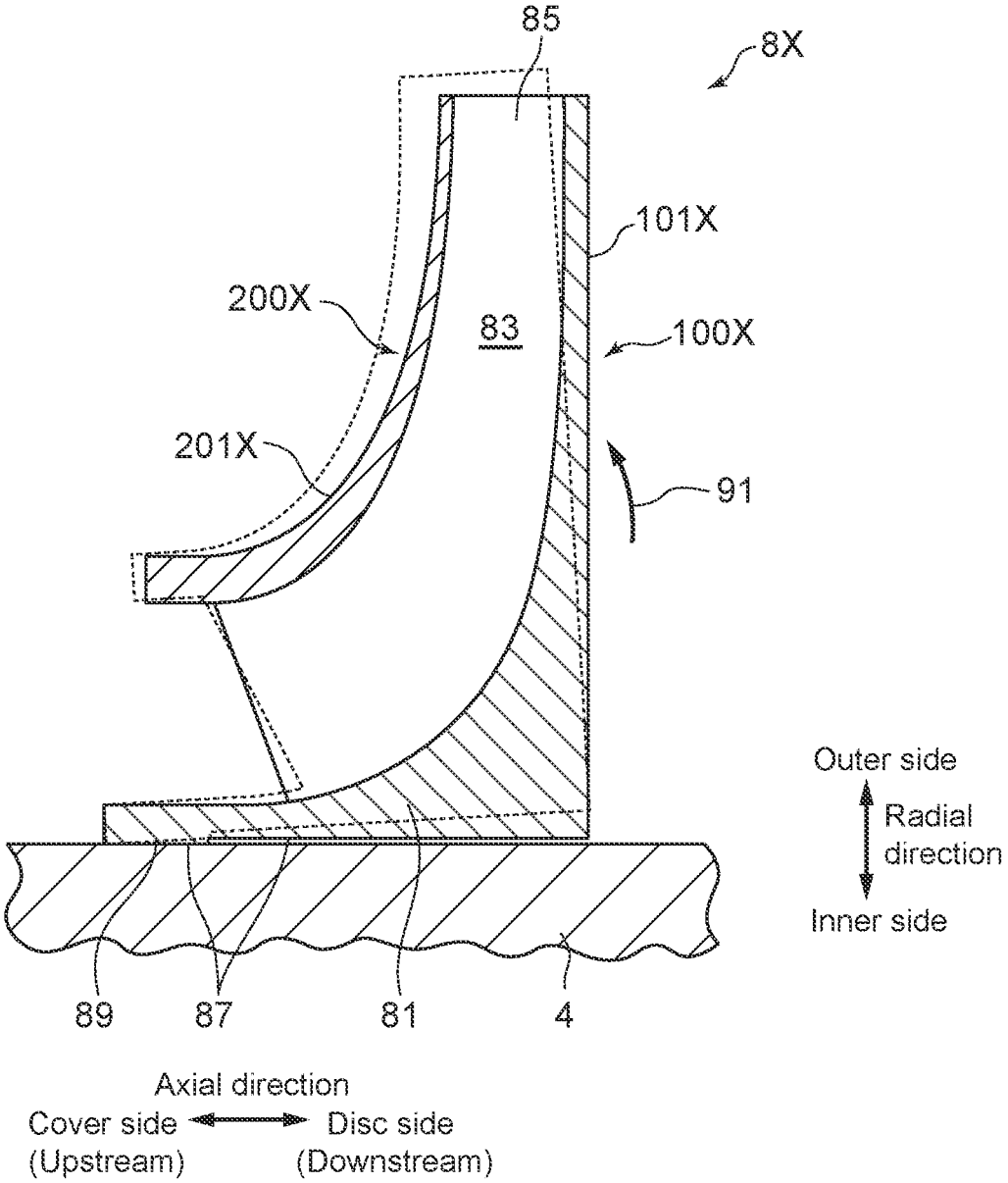
FIG. 6 is a schematic cross-sectional view of a conventional impeller, taken along the axial direction.

FIG. 6 is a schematic cross-sectional view of a conventional impeller, taken along the axial direction.

As shown in FIGS. 2 and 3, the impeller 8 according to some embodiments includes a disc 100 disposed integrally with a hub 81 on the back side of the hub 81, a cover 200 disposed on the opposite side of a radial passage 83 from the disc 100 in the axial direction, and a blade(s) 85 disposed between the disc 100 and the cover 200. That is, the impeller 8 according to some embodiments is a so-called closed impeller.

For convenience of explanation, with respect to the impeller 8, the axially upstream side of the centrifugal compressor 1 is referred to as the cover side, and the axially downstream side is referred to as the disc side.

In the impeller 8 according to some embodiments, the hub 81 has a through hole 87 into which the shaft 4 is inserted. In some embodiments, in a region on the cover side of the through hole 87, a fastening portion 89 to be fastened to the shaft 4 by shrink fitting is disposed. In other words, the impeller 8 according to some embodiments is fastened to the shaft 4 at the fastening portion 89 by shrink fitting.

In the impeller 8 according to some embodiments, a back surface 101 of the disc 100 has a recess 110 extending in the circumferential direction in a radial range where the blade 85 is disposed. In the impeller 8 according to some embodiments, the recess 110 is a portion recessed toward the cover side on the back surface 101 of the disc 100, and is formed over the entire circumference of the disc 100, for example.

Further, in the impeller 8 according to some embodiments, the disc 100 has an inner protruding portion 130 disposed radially inward of the recess 110 on the back surface 101 of the disc 100; and an outer protruding portion 150 disposed radially outward of the recess 110 on the back surface 101 of the disc 100.

In FIG. 2, the unevenness of the disc 100 in the axial direction are exaggerated.

Further, in FIG. 2, the shape of a back surface 101X of a disc 100X of a conventional impeller 8X (see FIG. 6) which does not have the recess 110, the inner protruding portion 130, and the outer protruding portion 150 is represented by the two-dot chain line.

As described above, since the unevenness of the disc 100 in the axial direction are exaggeratedly shown in FIG. 2, the axial position of the back surface 101 of the disc 100 of the impeller 8 according to some embodiments is not necessarily entirely located on the disc side (downstream side) of the axial position of the back surface 101X of the disc 100X of the conventional impeller 8X. For example, in at least a partial region of the recess 110, the axial position of the back surface 101 of the disc 100 of the impeller 8 according to some embodiments may be located on the cover side (upstream side) of the axial position of the back surface 101X of the disc 100X of the conventional impeller 8X. In other words, for example in at least a partial region of the recess 110, the thickness of the disc 100 of the impeller 8 according to some embodiments may be smaller than the thickness of a region of the disc 100X of the conventional impeller 8X corresponding in radial position to the partial region. Further, for example in at least a partial region of the outer protruding portion 150, the axial position of the back surface 101 of the disc 100 of the impeller 8 according to some embodiments may be located on the cover side (upstream side) of the axial position of the back surface 101X of the disc 100X of the conventional impeller 8X.

In the impeller 8 according to some embodiments, the cover 200 has a cover protruding portion 210 which protrudes so as to have a maximum thickness D between a radially inner end 203 and a radially outer end 205.

In other words, the cover 200 according to some embodiments is shaped such that an outer surface 201 of the cover 200 is partially raised and the thickness is partially increased.

In FIG. 2, the unevenness of the cover 200 in the thickness direction are exaggerated.

Further, in FIG. 2, the shape of an outer surface 201X of a cover 200X of the conventional impeller 8X which does not have the cover protruding portion 210 is represented by the two-dot chain line.

The portion of the cover protruding portion 210 with the maximum thickness D is referred to as a top portion 211.

As described above, since the unevenness of the cover 200 in the thickness direction are exaggeratedly shown in FIG. 2, the thickness of the cover 200 of the impeller 8 according to some embodiments is not necessarily entirely greater than the thickness of the cover 200X of the conventional impeller 8X. In other words, the thickness of the cover 200 of the impeller 8 according to some embodiments may be at least partially smaller than the thickness of the cover 200X of the conventional impeller 8X.

(Reason for Providing Recess 110)

Rotating machines such as a compressor are required to be smaller and less costly. As a method for responding to such requirements, for example, increasing the peripheral speed of the impeller may be mentioned.

When the rotational speed of the impeller is increased to respond to requirements of increasing the peripheral speed of the impeller, the centrifugal force acting on the impeller is increased, which causes an undesired phenomenon in the conventional impeller 8X due to deformation of the impeller 8X or the like.

Generally, as with the impeller 8 according to some embodiments, the conventional impeller 8X has a fastening portion 89 disposed at the axial position on the cover side of the through hole 87 into which the shaft 4 is inserted, and is thereby fastened to the shaft 4 by shrink fitting. Accordingly, as the centrifugal force acts on the peripheral portion of the through hole 87, the fastening force tends to decrease, so that the fastening force may become insufficient due to increasing the peripheral speed. Further, when the impeller 8X is fastened to the shaft 4 at the fastening portion 89 disposed at the axial position on the cover side of the through hole 87, as shown by the dotted line and the arrow 91 in FIG. 6, the centrifugal force tends to deform the impeller 8X so that it rises radially outward on the disc side. Such deformation may cause problems such as contact between the impeller 8X and the diaphragm 10 around the impeller 8X.

As a result of studies by the inventors, it was found that when the recess 110 extending in the circumferential direction is provided on the back surface 101 of the disc 100 in the radial range where the blade 85 is located, it is possible to suppress the reduction in fastening force with the shaft 4 by the following principle. Specifically, as shown in FIG. 3, when the centrifugal force acts on the disc 100, the disc 100 is deformed so as to fall toward the cover side as described above, and the cover 200 is pressed through the blade 85. At this time, when the disc 100 has the recess 110, the recess 110 acts as a bending point, and a region 100*b* of the disc 100 on the radially outer side of the recess 110 is deformed so as to further fall from the disc side to the cover side as shown by the arrow 93 with respect to a region 100*a* on the radially inner side of the recess 110. In other words, when the disc 100 has the recess 110, a relatively radially outer region of the disc 100 is deformed so as to further fall from the disc side to the cover side, as compared with the case where the disc 100 does not have the recess 110. Accordingly, a relatively radially outer region 200*b* of the cover 200 is pressed in the direction from the disc side to the cover side as shown by the arrow 95, so that pressing force F having radially inward components acts on a relatively radially inner region 200*a* of the cover 200 as shown by the arrow 97.

As a result, radially outward expansion in the vicinity of the fastening portion 89 is suppressed, so that the reduction in the fastening force is suppressed.

Therefore, with the impeller 8 according to some embodiments, it is possible to suppress the reduction in fastening force and contribute to the increase in peripheral speed of the impeller 8.

(Radial Position of Recess 110)

As a result of studies by the inventors, it was found that the deepest portion 111 of the recess 110 is desirably located in the range of 40% or more and 70% or less of the outer diameter of the disc 100 in order to effectively suppress the reduction in fastening force with the shaft 4 as described above.

Thus, in the impeller 8 according to some embodiments, the radial position of the recess 110 is set such that the deepest portion 111 of the recess 110 is in the range of 40% or more and 70% or less of the outer diameter of the disc 100. Thus, it is possible to effectively suppress the reduction in fastening force with the shaft 4.

(Inner Protruding Portion 130 and Outer Protruding Portion 150)

In the impeller 8 according to some embodiments, the disc 100 may have an inner protruding portion 130 and an outer protruding portion 150 on the back surface 101 of the disc 100.

As described above, the centrifugal force tends to deform the impeller 8 so that it rises radially outward on the disc side.

Therefore, for reducing the circumferential stress in order to suppress such deformation, it is conceivable to increase the thickness of the disc 100, for instance. However, when the thickness of the disc 100 is simply increased, the weight of the impeller 8 increases, so that the centrifugal force also increases, and the circumferential stress may not be effectively reduced. Further, since the disc 100 is provided with a plurality of blades 85, a high stress may be locally generated in the disc 100 due to a force received from the blades 85. Accordingly, for example, when the thickness of the disc 100 is reduced in order to reduce the centrifugal force, the influence of the local stress generated in the disc 100 may increase.

In order to effectively reduce the circumferential stress in the disc 100, it is desirable to increase the thickness of a relatively inner region in the radial direction.

Therefore, with the impeller 8 according to some embodiments, since the inner protruding portion 130 is provided, it is possible to effectively reduce the circumferential stress in the disc 100 (hub 81).

Further, as a result of studies by the inventors, it was found that when the outer protruding portion 150 is provided, is possible to reduce the influence of the local stress generated in the disc 100 as described above.

Therefore, with the impeller 8 according to some embodiments, it is possible to reduce the influence of the local stress generated in the disc 100.

In the impeller 8 according to some embodiments, the inner protruding portion 130 may be formed uniformly along the circumferential direction, i.e., such that the protrusion amount in the axial direction is constant regardless of the position in the circumferential direction. Alternatively, as described later, in the impeller 8 according to some embodiments, the protrusion amount of the inner protruding portion 130 may vary with the position in the circumferential direction.

Further, in the impeller 8 according to some embodiments, the outer protruding portion 150 may be formed uniformly along the circumferential direction. Alternatively, as described later, in the impeller 8 according to some embodiments, the protrusion amount of the outer protruding portion 150 may vary with the position in the circumferential direction.

(Relationship in Axial Position Between Recess 110, Inner Protruding Portion 130, and Outer Protruding Portion 150)

In the impeller 8 according to some embodiments, as shown in FIG. 3, when an axial distance B between the deepest portion 111 of the recess 110 and the top 131 of the inner protruding portion 130 is 1, an axial distance A between the deepest portion 111 and the top 151 of the outer protruding portion 150 may be 0.2 to 0.6 (both inclusive).

As a result of studies by the inventors, it was found that if the axial distance A between the deepest portion 111 and the top 151 of the outer protruding portion 150 is less than 0.2 when the axial distance B between the deepest portion 111 of the recess 110 and the top 131 of the inner protruding portion 130 is 1, the effect of the provision of the outer protruding portion 150 as described above may be insufficient. Further, it was found that if the axial distance A between the deepest portion 111 and the top 151 of the outer protruding portion 150 is more than 0.6 when the axial distance B between the deepest portion 111 of the recess 110 and the top 131 of the inner protruding portion 130 is 1, disadvantages due to the increase in weight of the disc 100 in the radially outer region 110*b* of the recess 110 may increase.

Therefore, with the impeller 8 according to some embodiments, since the axial distance A is set from 0.2 to 0.6 when the axial distance B is 1, it is possible to effectively reduce the influence of the local stress generated in the disc 100.

(Shape of inner protruding portion 130) In the impeller 8 according to some embodiments, as shown in FIGS. 2 and 3, the inner protruding portion 130 may be shaped such that the axial position of the inner protruding portion 130 approaches the cover 200 from the top 131 of the inner protruding portion 130 toward the radially inner side. In other words, in the impeller 8 according to some embodiments, as shown in FIGS. 2 and 3, the inner protruding portion 130 may be formed such that the thickness of the disc 100 gradually decreases from the top 131 of the inner protruding portion 130 toward the radially inner side.

As a result of studies by the inventors, it was found that even when the thickness of the disc 100 is increased in a region on the radially inner side of the top 131 shown in FIGS. 2 and 3, the effect of reducing the circumferential stress is relatively small although the weight of the disc 100 increases. Therefore, as shown in FIGS. 2 and 3, when the inner protruding portion 130 is shaped such that the axial position of the inner protruding portion 130 approaches the cover 200 from the top 131 of the inner protruding portion 130 toward the radially inner side, it is possible to suppress the increase in weight of the disc 100 while reducing the circumferential stress in the disc 100.

In the impeller 8 according to some embodiments, the back surface 101 of the disc 100 may be uneven in the circumferential direction in a radial position where the inner protruding portion 130 is located.

Specifically, since the disc 100 is provided with the blades 85 arranged at intervals in the circumferential direction, the stress generated in the disc 100 varies with the position in the circumferential direction. As a result of diligent studies by the inventors paying attention to this point, it was found that when the protrusion amount of the inner protruding portion 130 is varied with the position in the circumferential direction, it is possible to suppress the increase in weight due to the provision of the inner protruding portion 130 while reducing the circumferential stress in the disc 100.

Therefore, with the impeller 8 according to some embodiments, since the back surface 101 of the disc 100 is formed so as to be uneven in the circumferential direction in the radial range where the inner protruding portion 130 is located, it is possible to suppress the increase in weight due to the provision of the inner protruding portion 130 while reducing the circumferential stress in the disc 100.

More specifically, the back surface 101 of the disc 100 is preferably formed as described below.

Figure 4A:
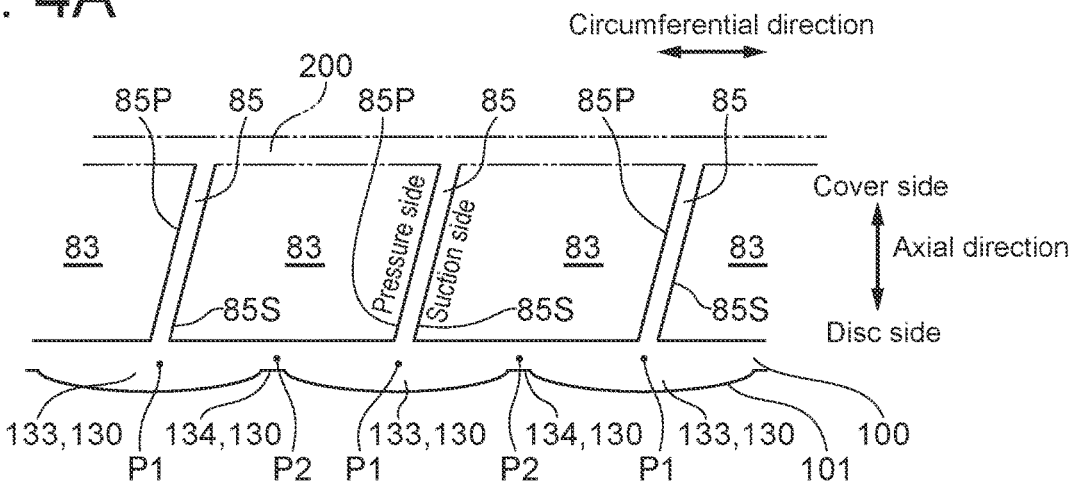
FIG. 4A is a schematic cross-sectional view taken along the line IV(A) in FIG. 2.

FIG. 4A is a schematic cross-sectional view taken along the line IV(A) in FIG. 2, i.e., at the radial position where the inner protruding portion 130 is located.

In the impeller 8 according to some embodiments, for example as shown in FIG. 4A, the thickness of the disc 100 in the radial position of the inner protruding portion 130 may be greater at a circumferential position P1 of the disc 100 corresponding to the installation position of each blade 85 than at a circumferential position P2 of the disc 100 corresponding to the intermediate position between two blades 85 adjacent along the circumferential direction.

In other words, for example, the inner protruding portion 130 according to some embodiments may be formed so as to have alternately in the circumferential direction a first protruding portion 133 with a relatively great axial protrusion amount at the circumferential position P1 corresponding to the installation position of each blade 85, and a second protruding portion 134 with a relatively small axial protrusion amount at the circumferential position P2 corresponding to the intermediate position between two blades 85 adjacent along the circumferential direction.

As a result of studies by the inventors, it was found that it is not necessary to increase the thickness of the disc 100 at the circumferential position P2 corresponding to the intermediate position between two adjacent blades.

Therefore, with the impeller 8 according to some embodiments, since the inner protruding portion 130 is formed so as to have alternately the first protruding portion 133 and the second protruding portion 134 in the circumferential direction, it is possible to effectively suppress the increase in weight due to the provision of the inner protruding portion 130 while reducing the circumferential stress in the disc 100.

(Shape of Outer Protruding Portion 150)

In the impeller 8 according to some embodiments, as shown in FIGS. 2 and 3, the outer protruding portion 150 may be shaped such that the axial position of the outer protruding portion 150 approaches the cover 200 from the top 151 of the outer protruding portion 150 toward the radially outer side. In other words, in the impeller 8 according to some embodiments, as shown in FIGS. 2 and 3, the outer protruding portion 150 may be formed such that the thickness of the disc 100 gradually decreases from the top 151 of the outer protruding portion 150 toward the radially outer side.

The magnitude of centrifugal force is proportional to the distance from the center O and the mass. Therefore, from the viewpoint of reducing the centrifugal force acting on the disc 100, it is desirable that the thickness of the disc 100 decreases as the distance from the center O of the disc 100 increases. Therefore, as shown in FIGS. 2 and 3, when the outer protruding portion 150 is shaped such that the axial position of the outer protruding portion 150 approaches the cover 200 from the top 151 of the outer protruding portion 150 toward the radially outer side, it is possible to reduce the centrifugal force acting on the disc 100.

In the impeller 8 according to some embodiments, the back surface 101 of the disc 100 may be uneven in the circumferential direction in a radial position where the outer protruding portion 150 is located.

As a result of studies by the inventors, it was found that, in the region 100*b* on the radially outer side of the recess 110, the local stress generated in the disc 100 is affected by the blades 85 attached at intervals in the circumferential direction and thus fluctuates periodically along the circumferential direction.

Therefore, with the impeller 8 according to some embodiments, since the back surface 101 of the disc 100 is formed so as to be uneven in the circumferential direction in the radial range where the outer protruding portion 150 is located, it is possible to suppress the increase in weight due to the provision of the outer protruding portion 150 while reducing the local stress generated in the disc 100.

More specifically, the back surface 101 of the disc 100 is preferably formed as described below.

Figure 4B:
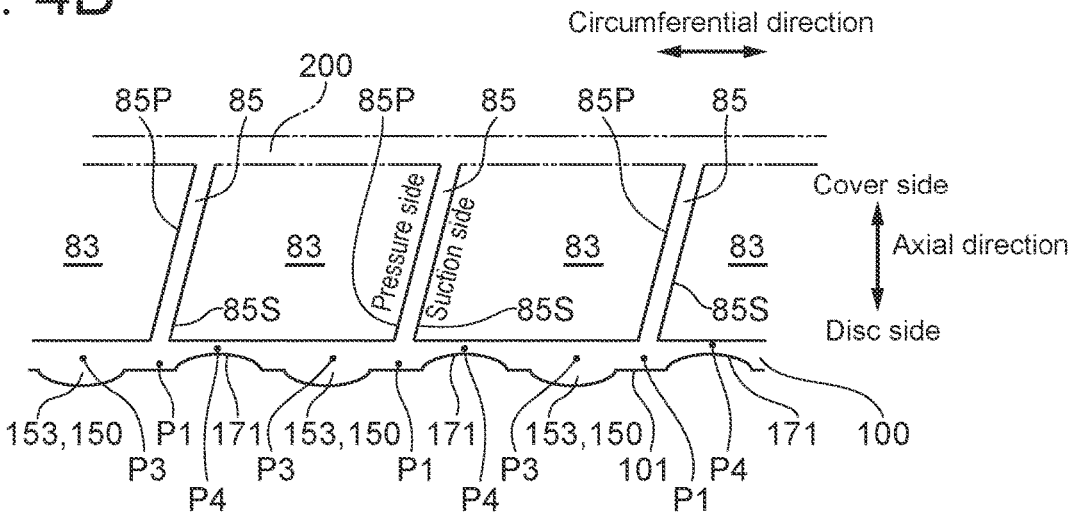
FIG. 4B is a schematic cross-sectional view taken along the line IV(B) in FIG. 2.

FIG. 4B is a schematic cross-sectional view taken along the line IV(B) in FIG. 2, i.e., at the radial position where the radially inner region 150*a* of the outer protruding portion 150 is located.

In the impeller 8 according to some embodiments, for example as shown in FIG. 4B, in a radial position where the radially inner region 150*a* of the outer protruding portion 150 is located, the thickness of the disc 100 may be greater at a position P3 of the disc 100 on the pressure side 85P of the blade 85 than at a position P4 of the disc 100 on the suction side 85S of the blade 85 with respect to the circumferential position P1 of the disc 100 corresponding to the installation position of the blade 85.

In other words, for example, the outer protruding portion 150 according to some embodiments may be formed such that a third protruding portion 153 with a relatively great axial protrusion amount is formed at the position P3 on the pressure side 85P of the blade 85 with respect to the circumferential position P1 corresponding to the installation position of the blade 85. Additionally, in the disc 100 according to some embodiments, a recessed portion 171 with a thickness of the disc 100 smaller than the thickness of the disc 100 including at least the third protruding portion 153 may be formed at the position P4 on the suction side 85S of the blade 85 with respect to the circumferential position P1 corresponding to the installation position of the blade 85. The axial position of at least a partial region of the recessed portion 171 according to some embodiments may be located on the cover side (upstream side) of the axial position of the back surface 101X of the disc 100X of the conventional impeller 8X.

As a result of studies by the inventors, it was found that, in the relatively radially inner region 150*a* of the region 100*b* on the radially outer side of the recess 110, the local stress generated in the disc 100 is relatively high at the position P3 on the pressure side 85P of the blade 85 with respect to the circumferential position P1 corresponding to the installation position of the blade 85.

Therefore, with the impeller 8 according to some embodiments, since the outer protruding portion 150 is formed such that the third protruding portion 153 appears periodically along the circumferential direction, it is possible to suppress the increase in weight due to the provision of the outer protruding portion 150 while reducing the local stress generated in the disc 100. Further, as described above, the outer protruding portion 150 may be formed such that the recessed portion 171 appears periodically along the circumferential direction, i.e., the third protruding portion 153 and the recessed portion 171 are alternated along the circumferential direction.

Figure 4C:
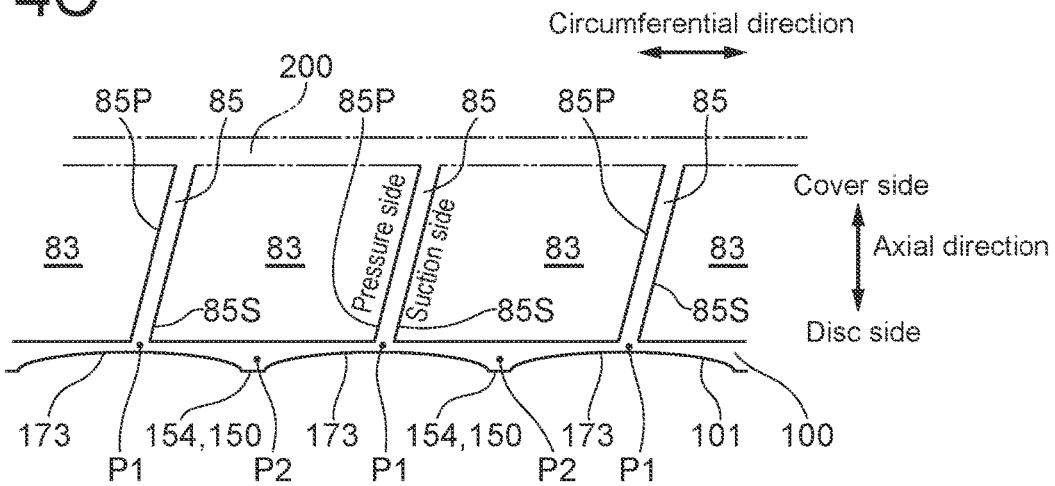
FIG. 4C is a schematic cross-sectional view taken along the line IV(C) in FIG. 2.

FIG. 4C is a schematic cross-sectional view taken along the line IV(C) in FIG. 2, i.e., at the radial position where the radially outer region 150*b* of the outer protruding portion 150 is located.

In the impeller 8 according to some embodiments, for example as shown in FIG. 4C, in a radial position where the radially outer region 150*b* of the outer protruding portion 150 is located, the thickness of the disc 100 may be greater at a circumferential position P2 corresponding to the intermediate position between two blades 85 adjacent along the circumferential direction than at a circumferential position P1 corresponding to the installation position of each blade 85.

In other words, for example, the outer protruding portion 150 according to some embodiments may be formed such that a fourth protruding portion 154 protruding in the axial direction is formed at the circumferential position P2 corresponding to the intermediate position between two blades 85 adjacent along the circumferential direction. Additionally, in the disc 100 according to some embodiments, a recessed portion 173 with a thickness of the disc 100 smaller than the thickness of the disc 100 including at least the fourth protruding portion 154 may be formed at the circumferential position P1 corresponding to the installation position of the blade 85. The axial position of at least a partial region of the recessed portion 173 according to some embodiments may be located on the cover side (upstream side) of the axial position of the back surface 101X of the disc 100X of the conventional impeller 8X.

As a result of studies by the inventors, it was found that, in the relatively radially outer region 150*b* of the region 100*b* on the radially outer side of the recess 110, the local stress generated in the disc 100 is relatively high at the circumferential position P2 corresponding to the intermediate position between two blades 85 adjacent along the circumferential direction.

Therefore, with the impeller 8 according to some embodiments, since the outer protruding portion 150 is formed such that the fourth protruding portion 154 appears periodically along the circumferential direction, it is possible to suppress the increase in weight due to the provision of the outer protruding portion 150 while reducing the local stress generated in the disc 100. Further, as described above, the outer protruding portion 150 may be formed such that the recessed portion 173 appears periodically along the circumferential direction, i.e., the fourth protruding portion 154 and the recessed portion 173 are alternated along the circumferential direction.

Although not depicted, the axial position in at least a partial region on the radially outer side of the IV(C) section in FIG. 2 may be located on the cover side (upstream side) of the axial position of the back surface 101X of the disc 100X of the conventional impeller 8X over the entire circumference.

(Shape of Cover 200)

In the impeller 8 according to some embodiments, the cover 200 may have a minimum thickness C on the radially outer side of a radial position where the cover 200 has the maximum thickness D such that a ratio of the minimum thickness C to the maximum thickness D is in a range of 0.2 to 0.6 (both inclusive). In the case where the radially outer end 205 of the cover 200 protrudes radially outward from a trailing edge 85T of the blade 85, the minimum thickness C is the minimum thickness of the portion of the cover 200 that protrudes radially outward from the trailing edge 85T of the blade 85.

As described above, when the centrifugal force acts on the disc 100, the disc 100 is deformed so as to fall toward the cover side, and the cover 200 is pressed through the blade 85.

In the impeller 8 according to some embodiments, since the disc 100 has the recess 110, as described above, a relatively radially outer region of the disc 100 is deformed so as to further fall from the disc side to the cover side, as compared with the case where the disc 100 does not have the recess 110.

When the disc 100 is deformed so as to further fall to the cover side, the relatively radially outer region 200*b* of the cover 200 is pressed mainly. Therefore, in order to generate pressing force F having radially inward components in the relatively radially inner region 200*a* of the cover 200, it is desirable to improve the bending rigidity of the cover 200, i.e., to increase the thickness of the cover 200.

However, simply increasing the thickness of the cover 200 increases the centrifugal force acting on the cover 200, so that the pressing force F is canceled under the influence of the increased centrifugal force.

Here, when the cover 200 is configured so as to have the maximum thickness D between the radially inner end 203 and the radially outer end 205, it is possible to suppress the increase in centrifugal force that cancels the pressing force F even if the thickness of the cover 200 is increased.

Further, as a result of studies by the inventors, it was found that when the cover 200 is configured so as to have the minimum thickness C on the radially outer side of a radial position where the cover has the maximum thickness D such that a ratio of the minimum thickness C to the maximum thickness D is in the range of 0.2 to 0.6, it is possible to reduce the thickness of the relatively radially outer region 200*b* of the cover 200, so that it is possible to suppress the increase in weight of the impeller 8.

Thus, with the impeller 8 according to some embodiments, it is possible to suppress the reduction in fastening force while suppressing the increase in weight of the impeller 8.

In the impeller 8 according to some embodiments, the front surface (outer surface 201) of the cover 200 may be uneven in the circumferential direction in a radial position where the cover 200 has the maximum thickness D.

As a result of studies by the inventors, it was found that, since the cover 200 is provided with the blades 85 at intervals in the circumferential direction, when the magnitude of the maximum thickness D, i.e., the thickness of the cover 200 is varied with the position in the circumferential direction in the radial position where the cover 200 has the maximum thickness D, it is possible to effectively generate the pressing force F, and it is possible to suppress the increase in weight due to increasing the thickness of the cover 200.

Therefore, with the impeller 8 according to some embodiments, it is possible to suppress the increase in weight due to increasing the thickness of the cover 200 while effectively suppressing the reduction in fastening force.

More specifically, the outer surface 201 of the cover 200 is preferably formed as described below.

Figure 5A:
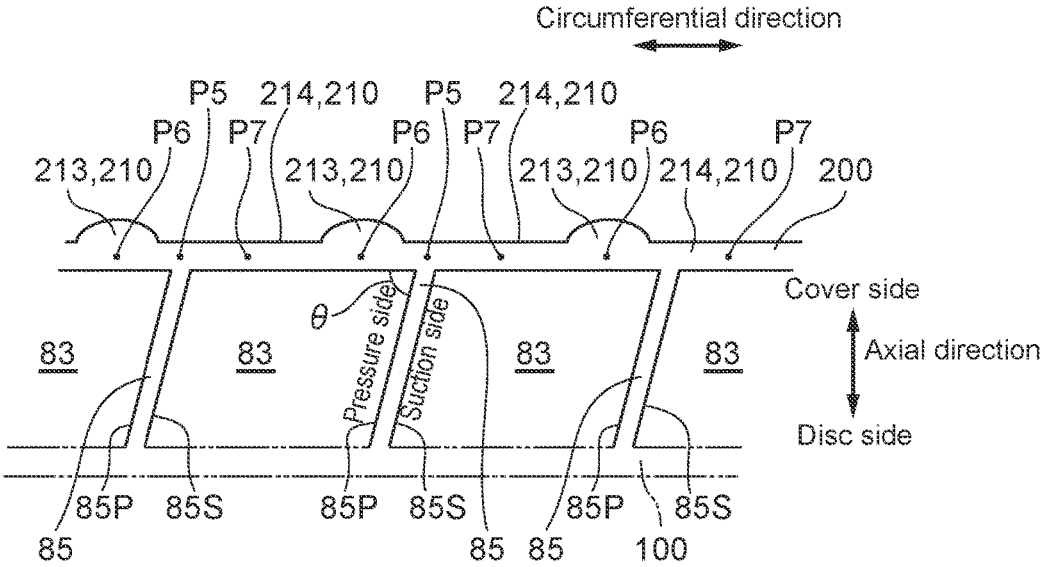
FIG. 5A is a schematic cross-sectional view taken along the line V(A) in FIG. 2.

FIG. 5A is a schematic cross-sectional view taken along the line V(A) in FIG. 2, i.e., at a position where the top portion 211 of the cover protruding portion 210 is located.

Figure 5B:
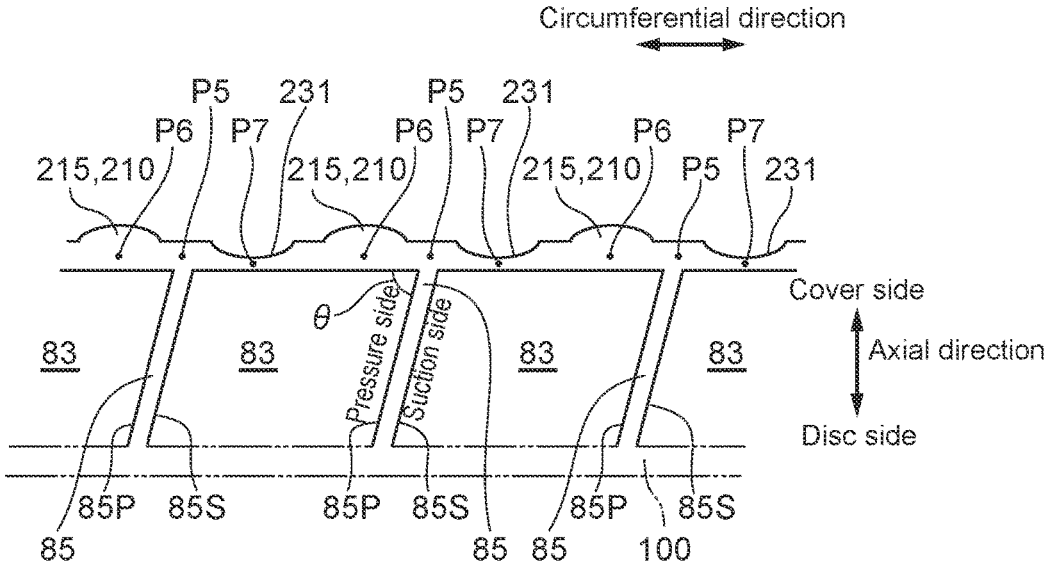
FIG. 5B is a schematic cross-sectional view taken along the line V(B) in FIG. 2.

FIG. 5B is a schematic cross-sectional view taken along the line V(B) in FIG. 2, i.e., at a position on the radially outer side of the top portion 211 of the cover protruding portion 210.

Figure 5C:
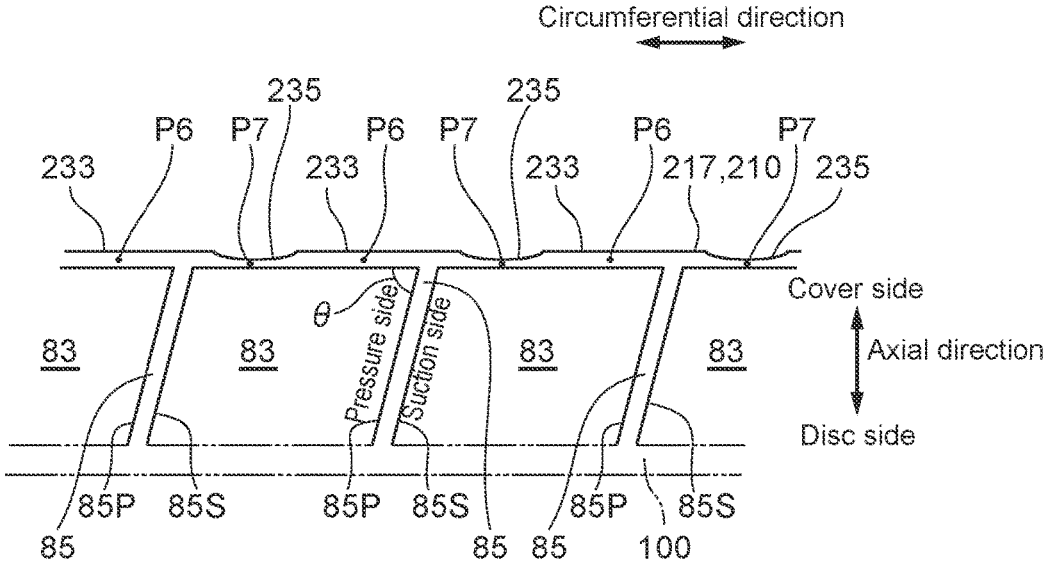
FIG. 5C is a schematic cross-sectional view taken along the line V(C) in FIG. 2.

FIG. 5C is a schematic cross-sectional view taken along the line V(C) in FIG. 2, i.e., at a position on the radially outer side of the V(B) section in FIG. 2 of the cover protruding portion 210.

In the impeller 8 according to some embodiments, for example as shown in FIGS. 5A to 5C, in the radial position where the cover 200 has the maximum thickness D, the thickness of the cover 200 may be set as follows. Specifically, P6 is defined as a position of the cover 200 on the pressure side 85P of the blade 85 with respect to a circumferential position P5 of the cover 200 corresponding to the installation position of the blade 85, and P7 is defined as a position of the cover 200 on the suction side 85S of the blade 85 with respect to the circumferential position P5. The thickness of the cover 200 may be greater at the position P6 than at the position P7.

In other words, for example as shown in FIG. 5A, the cover protruding portion 210 according to some embodiments may be formed such that, in the radial position where the top portion 211 of the cover protruding portion 210 is located, a first protruding portion 213 with a relatively great protrusion amount at the circumferential position P6 and a second protruding portion 214 with a relatively small protrusion amount at the circumferential position P7 are alternated in the circumferential direction.

Further, for example as shown in FIG. 5B, the cover protruding portion 210 according to some embodiments may be formed such that, on the radially outer side of the radial position where the top portion 211 of the cover protruding portion 210 is located, a third protruding portion 215 disposed in a circumferential position including the position P6 and a recessed portion 231 disposed in a circumferential position including the position P7 are alternated in the circumferential direction. The third protruding portion 215 is a portion with a protrusion amount which is relatively great but is smaller than the first protruding portion 213. The recessed portion 231 is a portion where the thickness of the cover 200 is smaller than the thickness of the cover 200 including at least the third protruding portion 215.

The thickness of the cover 200 in at least a partial region of the recessed portion 231 may be smaller than the thickness of a region of the cover 200X of the conventional impeller 8X corresponding in radial position to the partial region.

Further, for example as shown in FIG. 5C, the cover 200 according to some embodiments may be formed such that, on the radially outer side of the radial position where the third protruding portion 215 and the recessed portion 231 are formed, an outer peripheral region 233 including the position P6 and extending in the circumferential direction and a recessed portion 235 disposed in a circumferential position including the position P7 are alternated in the circumferential direction. The outer peripheral region 233 is a region where the thickness of the cover 200 is smaller than the thickness of the cover 200 including at least the third protruding portion 215. The recessed portion 235 is a portion where the thickness of the cover 200 is smaller than that of the outer peripheral region 233.

The thickness of the cover 200 in at least a partial region of the outer peripheral region 233 may be smaller than the thickness of a region of the cover 200X of the conventional impeller 8X corresponding in radial position to the partial region. Further, the thickness of the cover 200 in the recessed portion 235 may be smaller than the thickness of a region of the cover 200X of the conventional impeller 8X corresponding in radial position to this region.

As a result of studies by the inventors, it was found that when the thickness of the cover 200 is made greater at the position P6 on the pressure side 85P of the blade 85 than at the position P7 on the suction side 85S of the blade 85 with respect to the circumferential position P5 corresponding to the installation position of the blade 85, it is possible to effectively generate the pressing force F.

Therefore, with the impeller 8 according to some embodiments, it is possible to suppress the increase in weight due to increasing the thickness of the cover 200 while effectively suppressing the reduction in fastening force.

In the impeller 8 according to some embodiments, as shown in FIGS. 5A to 5C, an angle θ between the blade 85 and the cover 200 may be acute on the pressure side 85P of the blade 85.

As a result of studies by the inventors, it was found that when the angle θ between the blade 85 and the cover 200 is acute on the pressure side 85P of the blade 85, and the thickness of the cover 200 is made greater at the position P6 on the pressure side 85P of the blade 85 than at the position P7 on the suction side 85S of the blade 85 with respect to the circumferential position P5 corresponding to the installation position of the blade 85, it is possible to more effectively generate the pressing force F.

Therefore, with the impeller 8 according to some embodiments, it is possible to suppress the increase in weight due to increasing the thickness of the cover 200 while more effectively suppressing the reduction in fastening force.

With the centrifugal compressor 1 according to some embodiments, since the impeller 8 according to the above-described embodiments is included, it is possible to increase the peripheral speed of the impeller 8, so that it is possible to reduce the size and cost of the centrifugal compressor 1.

The present disclosure is not limited to the embodiments described above, but includes modifications to the embodiments described above, and embodiments composed of combinations of those embodiments.

For example, in the above-described embodiments, the impeller 8 has the recess 110, the inner protruding portion 130, the outer protruding portion 150, and the cover protruding portion 210. However, for example, the impeller 8 may have the cover protruding portion 210 but may not have the recess 110, the inner protruding portion 130, and the outer protruding portion 150. Further, the impeller 8 may have the recess 110, the inner protruding portion 130, and the outer protruding portion 150 but may not have the cover protruding portion 210.

In the above-described embodiments, the impeller 8 is used in the multi-stage centrifugal compressor 1 as an example of the rotating machine. However, the impeller 8 according to some embodiments may be used in other types of rotating machines, such as a single-stage compressor, a radial turbine, or a pump.

The contents described in the above embodiments would be understood as follows, for instance.

(1) An impeller 8 of a rotating machine according to at least one embodiment of the present disclosure comprises: a disc 100; a cover 200 disposed on the opposite side of a radial passage 83 from the disc 100 in the axial direction; and a blade 85 disposed between the disc 100 and the cover 200. A back surface 101 of the disc 100 has a recess 110 extending in the circumferential direction in a radial range where the blade 85 is disposed.

As described above, with the above configuration (1), it is possible to suppress the reduction in fastening force and contribute to the increase in peripheral speed of the impeller 8.

(2) In some embodiments, in the above configuration (1), the deepest portion 111 of the recess 110 may be in the range of 40% or more and 70% or less of the outer diameter of the disc 100.

With the above configuration (2), it is possible to effectively suppress the reduction in fastening force with the shaft 4.

(3) In some embodiments, in the above configuration (1) or (2), the disc 100 may have an inner protruding portion 130 disposed radially inward of the recess 110 on the back surface 101 of the disc 100, and an outer protruding portion 150 disposed radially outward of the recess 110 on the back surface 101 of the disc 100.

As described above, with the above configuration (3), since the inner protruding portion is provided, it is possible to effectively reduce the circumferential stress in the disc 100 (hub 81).

Further, with the above configuration (3), it is possible to reduce the influence of the local stress generated in the disc 100 as described above.

(4) In some embodiments, in the above configuration (3), when an axial distance B between the deepest portion 111 of the recess 110 and the top 131 of the inner protruding portion 130 is 1, an axial distance A between the deepest portion 111 and the top 151 of the outer protruding portion 150 may be 0.2 to 0.6.

With the above configuration (4), it is possible to effectively reduce the influence of the local stress generated in the disc 100.

(5) In some embodiments, in the above configuration (3) or (4), the axial position of the inner protruding portion 130 may approach the cover 200 from the top 131 of the inner protruding portion 130 toward the radially inner side.

With the above configuration (5), it is possible to suppress the increase in weight of the disc 100 while reducing the circumferential stress in the disc 100.

(6) In some embodiments, in any one of the above configurations (3) to (5), the back surface 101 of the disc 100 may be uneven in the circumferential direction in a radial position where the inner protruding portion 130 is located.

With the above configuration (6), it is possible to suppress the increase in weight of the disc 100 due to the provision of the inner protruding portion 130 while reducing the circumferential stress in the disc 100.

(7) In some embodiments, in the above configuration (6), the thickness of the disc 100 in the radial position of the inner protruding portion 130 may be greater at a circumferential position P1 corresponding to the installation position of each blade 85 than at a circumferential position P2 corresponding to the intermediate position between two blades 85 adjacent along the circumferential direction.

With the above configuration (7), it is possible to effectively reduce the circumferential stress in the disc 100 while suppressing the increase in weight due to the provision of the inner protruding portion 130.

(8) In some embodiments, in the any one of the above configurations (3) to (7), the axial position of the outer protruding portion 150 may approach the cover 200 from the top 151 of the outer protruding portion 150 toward the radially outer side.

With the above configuration (8), since the thickness of the disc 100 decreases toward the radially outer side, it is possible to reduce the centrifugal force acting on the disc 100.

(9) In some embodiments, in the above configuration (8), the back surface 101 of the disc 100 may be uneven in the circumferential direction in a radial position where the outer protruding portion 150 is located.

With the above configuration (9), it is possible to suppress the increase in weight of the disc 100 due to the provision of the outer protruding portion 150 while reducing the local stress generated in the disc 100.

(10) In some embodiments, in the above configuration (9), in a radial position where the radially inner region 150*a* of the outer protruding portion 150 is located, the thickness of the disc 100 may be greater at a position P3 on the pressure side 85P of the blade 85 than at a position P4 on the suction side 85S of the blade 85 with respect to the circumferential position P1 corresponding to the installation position of the blade 85.

With the above configuration (10), it is possible to suppress the increase in weight of the disc 100 due to the provision of the outer protruding portion 150 while reducing the local stress generated in the disc 100.

(11) In some embodiments, in the above configuration (9) or (10), in a radial position where the radially outer region 150*b* of the outer protruding portion 150 is located, the thickness of the disc 100 may be greater at a circumferential position P2 corresponding to the intermediate position between two blades 85 adjacent along the circumferential direction than at a circumferential position P1 corresponding to the installation position of each blade 85.

With the above configuration (11), it is possible to suppress the increase in weight of the disc 100 due to the provision of the outer protruding portion 150 while reducing the local stress generated in the disc 100.

(12) In some embodiments, in any one of the above configurations (1) to (11), the cover 200 may have a maximum thickness D between a radially inner end 203 and a radially outer end 205, and the cover 200 may have a minimum thickness C on the outer side of a radial position where the cover 200 has the maximum thickness D such that a ratio of the minimum thickness C to the maximum thickness D is in a range of 0.2 to 0.6.

With the above configuration (12), it is possible to suppress the reduction in fastening force while suppressing the increase in weight of the impeller 8.

(13) In some embodiments, in the above configuration (12), a front surface (outer surface 201) of the cover 200 may be uneven in the circumferential direction in the radial position where the cover 200 has the maximum thickness D.

With the above configuration (13), it is possible to suppress the increase in weight due to increasing the thickness of the cover 200 while effectively suppressing the reduction in fastening force.

(14) In some embodiments, in the above configuration (13), in the radial position where the cover 200 has the maximum thickness D, the thickness of the cover 200 may be greater at a position P6 on the pressure side 85P of the blade 85 than at a position P7 on the suction side 85S of the blade 85 with respect to a circumferential position P5 corresponding to the installation position of the blade 85.

With the above configuration (14), it is possible to suppress the increase in weight due to increasing the thickness of the cover 200 while effectively suppressing the reduction in fastening force.

(15) In some embodiments, in the above configuration (14), an angle θ between the blade 85 and the cover 200 may be acute on the pressure side 85P of the blade 85.

With the above configuration (15), it is possible to suppress the increase in weight due to increasing the thickness of the cover 200 while more effectively suppressing the reduction in fastening force.

(16) An impeller 8 of a rotating machine according to at least one embodiment of the present disclosure comprises: a disc 100; a cover 200 disposed on the opposite side of a radial passage 83 from the disc 100 in the axial direction; and a blade 85 disposed between the disc 100 and the cover 200. The cover 200 has a maximum thickness D between a radially inner end 203 and a radially outer end 205, and the cover 200 has a minimum thickness C on the outer side of a radial position where the cover 200 has the maximum thickness D such that a ratio of the minimum thickness C to the maximum thickness D is in a range of 0.2 to 0.6.

With the above configuration (16), it is possible to suppress the reduction in fastening force while suppressing the increase in weight of the impeller 8.

(17) A centrifugal compressor 1 as a rotating machine according to at least one embodiment of the present disclosure comprises the impeller 8 having any one of the above configurations (1) to (16).

With the above configuration (17), it is possible to increase the peripheral speed of the impeller 8, so that it is possible to reduce the size and cost of the centrifugal compressor 1.

The invention claimed is:

1. An impeller of a rotating machine, comprising:

a disc;

a cover disposed on an opposite side of a radial passage from the disc in an axial direction; and a blade disposed between the disc and the cover, wherein a back surface of the disc has a recess extending in a circumferential direction in a radial range where the blade is disposed, and the disc has:

an inner protruding portion disposed radially inward of the recess on the back surface of the disc; and an outer protruding portion disposed radially outward of the recess on the back surface of the disc.

2. The impeller according to claim 1, wherein, when an axial distance between a deepest portion of the recess and a top of the inner protruding portion is 1, an axial distance between the deepest portion and a top of the outer protruding portion is 0.2 to 0.6.

3. The impeller according to claim 1, wherein an axial position of the inner protruding portion approaches the cover from a top of the inner protruding portion toward a radially inner side.

4. The impeller according to claim 1, wherein the back surface of the disc is uneven in the circumferential direction in a radial position where the inner protruding portion is located.

5. The impeller according to claim 4, wherein a thickness of the disc in a radial position of the inner protruding portion is greater at a circumferential position corresponding to an installation position of the blade than at a circumferential position corresponding to an intermediate position between two blades adjacent along the circumferential direction.

6. The impeller according to claim 1, wherein an axial position of the outer protruding portion approaches the cover from a top of the outer protruding portion toward a radially outer side.

7. The impeller according to claim 6, wherein the back surface of the disc is uneven in the circumferential direction in a radial position where the outer protruding portion is located.

8. The impeller according to claim 7, wherein, in a radial position where a radially inner region of the outer protruding portion is located, a thickness of the disc is greater at a position on a pressure side of the blade than at a position on a suction side of the blade with respect to a circumferential position corresponding to an installation position of the blade.

9. The impeller according to claim 7, wherein, in a radial position where a radially outer region of the outer protruding portion is located, a thickness of the disc is greater at a circumferential position corresponding to an intermediate position between two blades adjacent along the circumferential direction than at a circumferential position corresponding to an installation position of the blade.

10. An impeller of a rotating machine, comprising:

a disc;

a cover disposed on an opposite side of a radial passage from the disc in an axial direction; and a blade disposed between the disc and the cover, wherein a back surface of the disc has a recess extending in a circumferential direction in a radial range where the blade is disposed, the cover has a maximum thickness between a radially inner end and a radially outer end, and the cover has a minimum thickness on an outer side of a radial position where the cover has the maximum thickness such that a ratio of the minimum thickness to the maximum thickness is in a range of 0.2 to 0.6, and a front surface of the cover is uneven in the circumferential direction in the radial position where the cover has the maximum thickness.

11. The impeller according to claim 10, wherein in the radial position where the cover has the maximum thickness, the thickness of the cover is greater at a position on a pressure side of the blade than at a position on a suction side of the blade with respect to a circumferential position corresponding to an installation position of the blade.

12. The impeller according to claim 11, wherein an angle between the blade and the cover is acute on the pressure side of the blade.

13. An impeller of a rotating machine, comprising:

a disc;

a cover disposed on an opposite side of a radial passage from the disc in an axial direction; and a blade disposed between the disc and the cover, wherein the cover has a maximum thickness between a radially inner end and a radially outer end, and the cover has a minimum thickness on an outer side of a radial position where the cover has the maximum thickness such that a ratio of the minimum thickness to the maximum thickness is in a range of 0.2 to 0.6, and a front surface of the cover is uneven in a circumferential direction in the radial position where the cover has the maximum thickness.

14. A rotating machine, comprising the impeller according to claim 1.

* * * * *